United States Patent [19]

Clearman

[11] Patent Number: 4,773,594

[45] Date of Patent: Sep. 27, 1988

[54] CONTROLLED PATTERN WOBBLING SPRINKLER

[76] Inventor: Jack F. Clearman, Rte. 4, Box 243, Blakely, Ga. 31723

[21] Appl. No.: 882,270

[22] Filed: Jul. 7, 1986

[51] Int. Cl.[4] ..... B05B 3/00

[52] U.S. Cl. ..... 239/229; 239/233; 239/265

[58] Field of Search ..... 239/229, 233, 264, 265, 239/210

[56] References Cited

U.S. PATENT DOCUMENTS

| | | | |
|---|---|---|---|
| 2,620,231 | 11/1952 | King | 239/229 |
| 2,848,276 | 8/1958 | Clearman | 239/382 |
| 3,357,643 | 12/1967 | Hruby | 239/210 |
| 3,539,109 | 11/1970 | Rosenberg | 239/233 |
| 4,487,368 | 12/1984 | Clearman | 239/229 |

FOREIGN PATENT DOCUMENTS

| | | | |
|---|---|---|---|
| 158716 | 10/1939 | Austria | 239/229 |
| 172230 | 2/1952 | Austria | 239/229 |
| 699339 | 11/1940 | Fed. Rep. of Germany | 239/233 |
| 903592 | 10/1945 | France | 239/229 |

*Primary Examiner*—Kenneth J. Dorner
*Assistant Examiner*—Gerald A. Anderson
*Attorney, Agent, or Firm*—Richard E. Brink

[57] ABSTRACT

A wobbling water distributor head mounted at the end of an angularly disposed tubular water-transporting arm. The base of the distributor head is mounted loosely between spaced shoulders. The wobbling motion of the head causes the distributor arm to traverse a circular path. The area sprinkled is controlled by varying the distance between the shoulders as the distributor arm rotates.

8 Claims, 2 Drawing Sheets

CONTROLLED PATTERN WOBBLING SPRINKLER

BACKGROUND OF THE INVENTION

This invention relates to sprinklers, especially to sprinklers for supplying water to lawns and other vegetation. More particularly, the invention relates to sprinklers having a wobbling water distributor head, providing a means for controlling the dimensions of the area to which water is supplied by the sprinkler.

U.S. Pat. No. 4,487,368, the disclosure of which is incorporated herein by reference, describes a sprinkler device incorporating a novel wobbling water distributor head mounted at the end of a tubular water-supplying support arm. The wobbling motion of the distributor head causes the support arm, (and, of course, the water stream) to describe a circular path, so that the sprinkler supplies water to a circular surrounding area. Although the radius of this circular area can be varied somewhat by controlling the pressure of the water supplied to the sprinkler, the device does not provide for sprinkling an area of any other shape.

BRIEF SUMMARY

The present invention constitutes an improvement over the spinkler of aforementioned U.S. Pat. No. 4,487,368 in that the area to which water is supplied can be adjusted and varied by means of a simple adjustment to the sprinkler without adjusting the pressure of the water supplied. The invention provides a simple means for providing water to noncircular areas, e.g., square or rectangular areas.

The sprinkler of U.S. Pat. No. 4,487,368 is a device comprising a wobbling water distributor head having a base end with a hole extending therethrough, the base being loosely mounted on the distal portion of an angularly disposed tubular water-transporting arm between spaced upper and lower shoulders, the arm being horizontally rotatable about a locus at its proximal end. The improvement contributed by the present invention comprises means for controllably varying the distance between the shoulders, whereby the dimensions of the area watered by the device are also controllably varied.

BRIEF DESCRIPTION OF THE DRAWING

Understanding of the invention will be enhanced by referring to the accompanying drawing, in which like numbers refer to like parts in the several views and in which.

DETAILED DESCRIPTION

Figure 1:
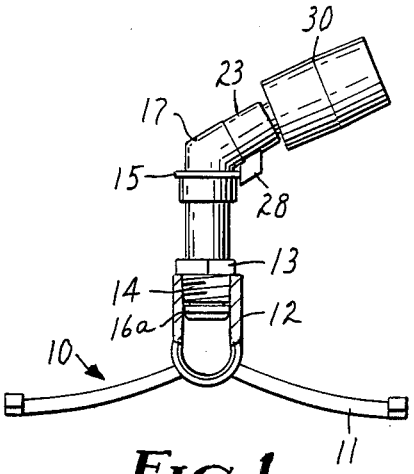
FIG. 1 is a front elevation view of a sprinkler made in accordance with the invention, shown in partial cross-section to facilitate understanding.
Figure 2:
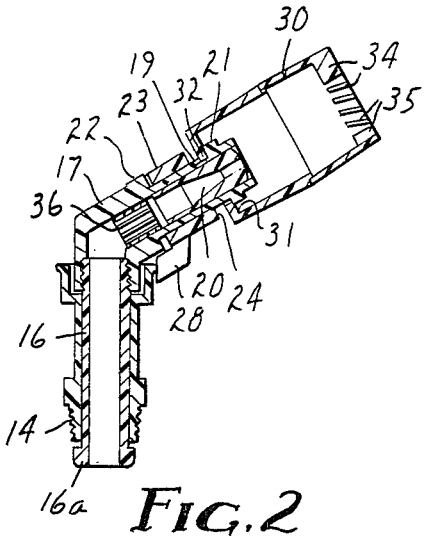
FIG. 2 is a cross-sectional view of a portion of the device of FIG. 1.

First considering the device of FIGS. 1–4, sprinkler base 10 comprises sled 11 connected to housing 12. At the upper side of housing 12 is an internally threaded opening, into which is threaded vertically extending bearing 13, at the upper end of which is located suitably contoured (e.g., square) cam 15. Rotatably positioned within bearing 13 is vertical water transport 16, having head 16*a*, which seats against the lower end of bearing 13. The upper end of water transport 16 is threaded, and angularly disposed tubular water-transporting support arm 17 is attached thereto.

The interior of support arm 17 is optionally provided with flow straightener 36 to minimize turbulence of the water stream passing therethrough. At its distal end, support arm 17 is provided with nozzle 20, having at its outer end a circular ridge, the lower portion of which functions as upper shoulder 21, in a manner to be described. Slidably surrounding support arm 17 is spacer sleeve 23, the distal edge of which functions as lower shoulder surface 24. Generally cup-shaped distributor head 30 has a base 31, in the central portion of which is hole 32. Base 31 of distributor head 30 is mounted between upper shoulder 21 and lower shoulder 24, hole 32 loosely surrounding nozzle 20. Axially extending rib 19 in the upper surface of nozzle 20 fits loosely into notch 33 extending from the portion of base 31 that surrounds hole 32, rib 19 and notch 33 forming a cooperative means that prevents distributor head 30 from rotating but permitting it to wobble as one portion of the inner surface of base 31 contacts upper shoulder 21; the diametrically opposite outer surface of base 31 contacts the lower shoulder 24. The less the distance between upper shoulder 21 and lower shoulder 24, the shorter the distance that the discharge end of distributor 30 moves from side to side during the wobbling process and the greater the distance that the stream of water will project. It will be appreciated, of course, that the notch could be on nozzle 20 and the corresponding rib on base 31. If the notch and rib were both eliminated, however, distributor head 30 would be free to precess. While not objectionable per se, such an arrangement would require the water jet to contact all the vanes in order to effect a wobbling motion. With driver vanes 34 always at the top and extending past 90° in the direction of wobble, operation is assured even when the water jet does not contact distributing vanes 35 at all.

The discharge end of distributor head 30 is provided with internal driver vanes 34 and distributing vanes 35, extending at a slight angle (e.g., 15°) to the longitudinal axis of head 20. Driver vanes 34, located at the upper portion of head 30, are longer than distributor vanes 35, ensuring that a stream of water will strike them when the sprinkler is initially turned on. As the water strikes driver vanes 34, their angled orientation causes head 30 to seek to rotate. Because notch 33 is loosely seated in rib 19, rotation of base 31 is prevented; the discharge end of distributor head 30, however, is not restricted in this manner, and a wobbling motion then takes place. As the water strikes vanes 34 and 35, it is broken into coarse drops, which are sprayed over the area between distributor head 30 and the maximum radial distance achieved as head 30 wobbles. As is described in more detail in aforementioned U.S. Pat. No. 4,487,368, the wobbling motion also causes support arm 17 to be rotated about vertical water transport 16, resulting in water's being supplied over the area surrounding water transport 16.

The distal edge of support arm 17 is provided with axially extending tongue 22, and the lower edge of spacer sleeve 23 is provided with a series of axially extending grooves, viz., camming groove 25 and circle-generating grooves 26 and 27, the desired one of which is fitted to tongue 22 during operation of the sprinkler by appropriately rotating sleeve 23. Groove 26 is shorter than groove 27, so that when tongue 22 is fitted into groove 26 the distance between shoulders 21 and 24 is less than when tongue 22 is fitted into groove 27. Thus, as has been previously indicated, fitting tongue 22 into groove 26 will cause a stream of water to project to a greater radial distance than fitting it into groove 27, the greatest distance being achieved when the stream makes minimal contact with driver vanes 34 and no contact with distributor vanes 35. The shortest radial distance is reached by the water stream when all vanes are contacted during the wobble. Grooves 26 and 27 may thus be employed to control the size of the circular area sprinkled. It will, of course, be apparent that more than two grooves could be provided, permitting even further control of the size of the area sprinkled.

When sleeve 23 is rotated so that camming groove 25 mates with tongue 22, a different effect is achieved. Cam follower 28, which is incorporated into sleeve 23, is then so positioned that it contacts cam 15. As support arm 17 rotates about vertical water transport 16 and cam follower 28 follows cam 15 sleeve 23 is moved axially in and out, varying with the peripheral contour of cam 15. As a result, the distance that a stream of water is projected is correspondingly increased and decreased. Cam 15 is shown as a square, but it will be readily appreciated that it could be rectangular, in the shape of other polygons, elliptical, curvilinear, etc. depending on the contours of the area to be sprinkled. To minimize friction between cam 15 and cam follower 28 and enhance smoothness of rotation, sharp angles on cam 15 should be avoided, rounding off all corners.

FIGS. 6–11 depict other embodiments of the invention, employing the principles just discussed. The device of FIGS. 5–8 is essentially the same as that of FIGS. 9 and 10, the latter differing only in that water supply 55 is provided at a location that is slightly offset, which facilitates the horizontal rotation of the support arm about its proximal end. Dimensions of the parts in these two embodiments differ somewhat but have no significant effect on performance.

Figure 7:
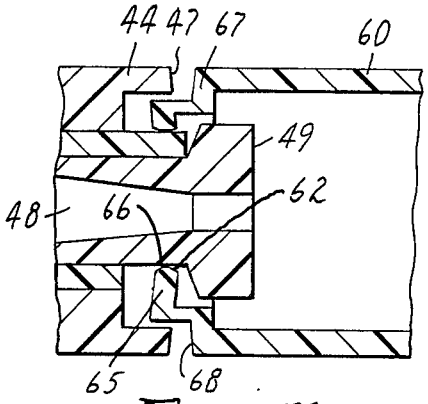
FIG. 7 is a greatly enlarged cross-sectional view of a portion of the devices of FIGS. 1, 2, 5 and 6, showing how the water distributor head is mounted.
Figure 3:
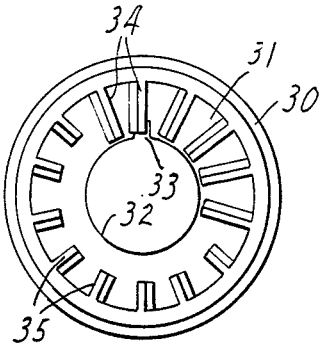
FIG. 3 is an end view of the distributor head used in the device of the invention.
Figure 4:
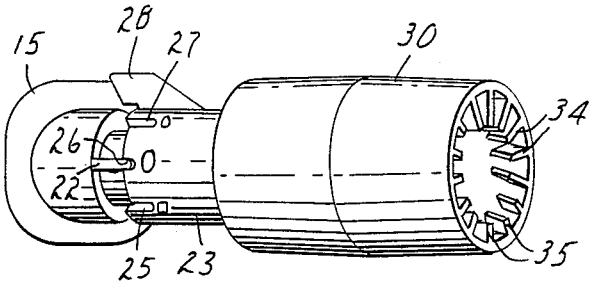
FIG. 4 is an upper view of the device of FIGS. 1 and 2, showing the arrangement of parts for distributing water over a large circular area.
Figure 5:
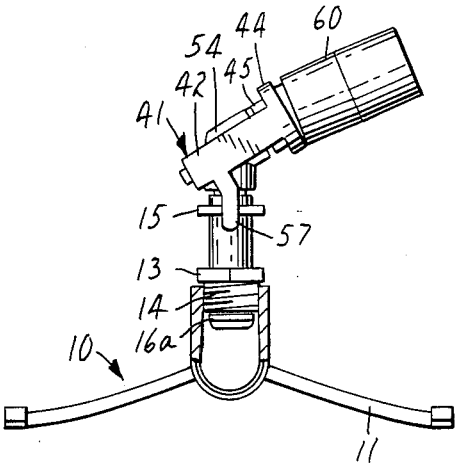
FIG. 5 is a front elevation view of an alternate form of the invention, shown in partial cross-section to facilitate understanding, arranged to distribute water over a square area.
Figure 6:
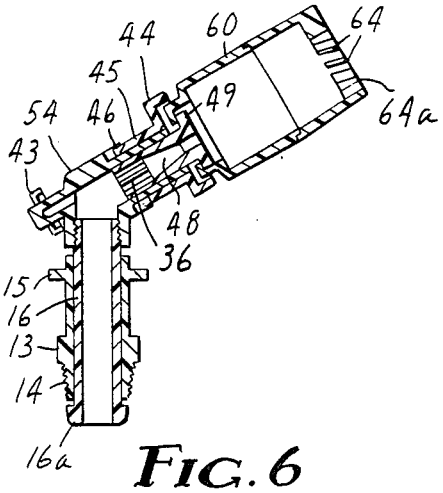
FIG. 6 is a cross-sectional view of a portion of the device of FIG. 5.
Figure 8:
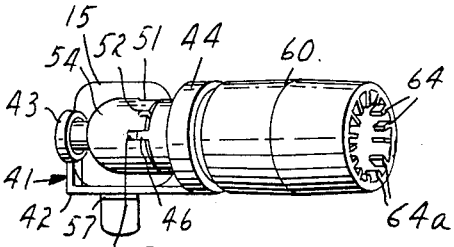
FIG. 8 is an upper view of the device of FIG. 5.
Figure 9:
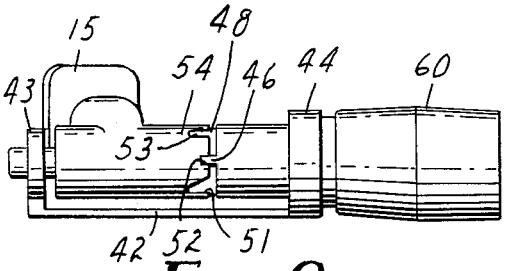
FIG. 9 is an upper view of a device substantially similar to that of FIG. 8 but showing a horizontally offset water supply.
Figure 10:
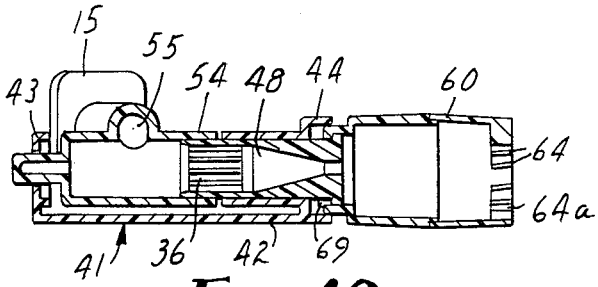
FIG. 10 is an upper cross-sectional view of the device of FIG. 9.
Figure 11:
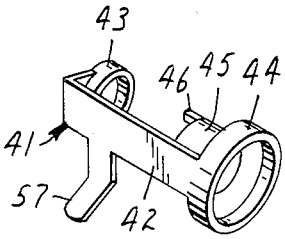
FIG. 11 is a perspective view of a spanner suitable for incorporation in the devices of FIGS. 6–10.

In FIGS. 6 and 7, angled support arm 54 is mounted at the top of vertical water transport 16. Support arm 54 is surrounded by spanner 41, comprising spacer 42, at the opposite ends of which are lower ring 43 and upper ring 44; integral with ring 44 is spacer sleeve 45, from the lower end of which tang 46 extends. Cam follower 57 is also integral with spacer 42, being adapted to contact cam 15 when spanner 42 is appropriately rotated about support arm 54. Positioned in the interior of support arm 54, so as to be in line with the direction of water flow, is nozzle 48, at the outer end of which is a ridge having conically tapered lower surface serving as upper shoulder. The upper edge of ring 44 is also conically tapered, functioning as lower shoulder 47.

As is particularly shown in FIG. 7, distributor head 60 includes base 67, having outwardly conically tapered portion 68 and inwardly conically tapered portion 65, the radially inner portion defining central hole 62. Distributor head 60 is so mounted that hole 62 surrounds nozzle 48, with base portions 65 and 68 positioned between upper shoulder 49 and lower shoulder 47. The contacting portions of base 67 and the shoulders (65 and 49, 68 and 47) are desirably identically conically tapered and provided with equal radii or circumferences, thereby minimizing frictional contact or relative movement, enhancing the wobbling tendency of distributor head 60 and increasing the efficiency of operation. Driver vanes 64, located at the discharge end of distributor head 60, impart a wobbling motion in essentially the same manner as that described with respect to the device of FIGS. 1–5, distributor vanes **64*a* functioning in a manner analogous to that of distributor vanes 35. Notch 33, located along the perimeter of hole 62, combines with rib 19 to prevent head 60 from rotating on support arm 54**.

An intermediate portion of support arm 54 is provided with camming groove 51 and circle-generating grooves 52 and 53; spacer 42 is rotated to permit seating of tang 46 in the appropriate groove. Camming groove 51, in which tang 46 is seated when cam follower 57 contacts cam 15, is V-shaped to facilitate inward and outward motion of sleeve 45 when a noncircular pattern is to be sprinkled, and promote smoothness of operation. When tang 46 is seated in camming groove 51, spanner 41 is caused to rotate a few degrees by the interaction between cam 15 and cam follower 57, forcing a camming action between the slope of camming groove 51 and tang 46, thus advancing spanner 41 outward axially and closing the space between upper ring 44 and upper shoulder 49, thereby increasing the distance a stream of water is thrown from nozzle 48. As cam follower 57 continues to follow cam 15, the axial distance between upper ring 44 and upper shoulder 49 increases, thereby decreasing the distance the stream of water is thrown. As will be seen, the contour of the area sprinkled is geometrically similar to the shape of cam 15.

It will be appreciated that the foregoing description is exemplary and does not expressly disclose all possible variations of the invention. For example, surfaces that contact each other during the wobbling process may be covered with rubber to reduce noise.

I claim:

1. In a sprinkling device of the type comprising a wobbling water distributor head that has a base with a hole extending therethrough, said base being loosely mounted on the distal portion of a tubular water-transporting support arm between two spaced shoulders, the improvement comprising one shoulder's being mounted on a loose-fitting sleeve that surrounds the support arm, and means located on said arm for moving the sleeve and the shoulder mounted thereon toward or away from the other shoulder and thereby continually and controllably varying the distance between said shoulders while said device is carrying out its sprinkling function, whereby the dimensions of the area watered by said device are also controllably varied.

2. The invention of claim 1 wherein the sleeve incorporates first means that contact and cooperate with second means elsewhere on said device to position said sleeve at varying desired axial positions on said support arm.

3. The invention of claim 2 wherein the support arm is angularly disposed and its proximal end is horizontally rotatably connected to a vertical water supply pipe, one shoulder being mounted on a loose-fitting sleeve that surrounds the support arm, said device including a horizontally disposed cam having a perimeter similar in shape to the area to be sprinkled, and a cam follower affixed to the sleeve and adapted to be placed in contact with the cam.

4. The invention of claim 3 wherein the sleeve can be rotated so that the cam follower does not contact the cam and there is a tongue on one of said positioning means extending generally parallel to the axis of the support arm, there also being a plurality of grooves parallel to said axis and adapted to receive said tongue, thereby setting the spacing between said shoulders at a desired fixed distance and correspondingly setting the area to be watered at a circle of the desired size.

5. The invention of claim 4 wherein the tubular support arm is laterally offset with respect to the water supply pipe, thereby enabling the water stream emitted by the distributor head to rotate the arm about a vertical axis more easily.

6. The invention of claim 5 wherein cooperative means respectively mounted on the support arm and the base of the distributor head interact to prevent the base of the distributor head from rotating.

7. The invention of claim 6 wherein the cooperative means comprises one or more axially extending ribs on the periphery of the arm and one or more corresponding notches on the interior of the hole in the base of the distributor head.

8. The invention of claim 1 wherein the base of the water distributor head is so contoured that it has the same radius as the portion of each shoulder with which it comes in contact.

* * * * *